US008944429B2

(12) United States Patent
Kataoka

(10) Patent No.: US 8,944,429 B2
(45) Date of Patent: Feb. 3, 2015

(54) SHEET FEEDING DEVICE AND IMAGE FORMING APPARATUS

(71) Applicant: Canon Kabushiki Kaisha, Tokyo (JP)

(72) Inventor: Hisashi Kataoka, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/187,883

(22) Filed: Feb. 24, 2014

(65) Prior Publication Data

US 2014/0246826 A1 Sep. 4, 2014

(30) Foreign Application Priority Data

Mar. 1, 2013 (JP) ..... 2013-040555

(51) Int. Cl.
*B65H 1/00* (2006.01)
*B65H 1/04* (2006.01)
*B65H 9/08* (2006.01)

(52) U.S. Cl.
CPC ... *B65H 1/04* (2013.01); *B65H 9/08* (2013.01)
USPC ..... 271/171; 271/147

(58) Field of Classification Search
CPC ..... B65H 1/00; B65H 1/04; B65H 2405/10; B65H 2511/10; B65H 2511/12
USPC ..... 271/145, 171, 147
See application file for complete search history.

(56) References Cited

FOREIGN PATENT DOCUMENTS

| | | | |
|---|---|---|---|
| JP | 60-44434 | * | 3/1985 |
| JP | 05-105243 A | | 4/1993 |
| JP | 2000-25983 | * | 1/2000 |
| JP | 2001-106361 | * | 4/2001 |

* cited by examiner

*Primary Examiner* — Thomas Morrison
(74) *Attorney, Agent, or Firm* — Fitzpatrick, Cella, Harper & Scinto

(57) ABSTRACT

A sheet feeding cassette includes a sheet stacking portion provided turnably in a vertical direction within a cassette body. The sheet feeding cassette also includes first and second side edge restricting portions configured to restrict widthwise positions of the sheets. The second side edge restricting portion includes first and second pressing portions configured to press the sheets on the sheet stacking portion against the first side edge restricting portion. The second pressing portion provided upstream in the sheet feeding direction of the first pressing portion is moved up and down by an interlock mechanism in linkage with a total thickness of the sheets on the sheet stacking portion.

13 Claims, 8 Drawing Sheets

SHEET FEEDING DEVICE AND IMAGE FORMING APPARATUS

BACKGROUND OF THE INVENTION

1. Field of the Invention

The present invention relates to a sheet feeding device configured to feed a sheet and to an image forming apparatus.

2. Description of the Related Art

Conventionally, an image forming apparatus such as a printer and a copier is provided with a sheet feeding device configured to feed sheets stacked on an intermediate plate provided in a cassette for storing the sheets, i.e., recording media such as plain sheets, OHPs, coated sheets, one by one to an image forming portion. By the way, if the sheet fed from the sheet feeding device to the image forming portion skews or is shifted in a width direction orthogonal to a feed direction, misregistration occurs in an image to be formed on the sheet.

Then, a pair of right and left side restricting plates, i.e., side edge restricting portions, is provided in the cassette in order to restrict widthwise positions of the sheets stacked on the intermediate plate. One of the pair of side restricting plates is set as a side restricting plate having a feed reference plane to feed the sheet such that a position of an image is appropriately adjusted with a position of the sheet in the image forming portion. The side restricting plate having the reference plane will be referred to as a 'reference side restricting plate' hereinafter. The other one of the pair of side restricting plates will be referred to as a 'non-reference side restricting plate' hereinafter. This pair of side restricting plates, i.e., the reference and non-reference side restricting plates, is provided to be able to approach/separate to/from each other corresponding to a size of the sheet. For example, the pair of side restricting plates can be fixed to restrict the sheets at positions corresponding to standards of sizes of the sheets such as A and B series sheets.

A distance between the pair of side restricting plates is set such that the side restricting plates are fixed at positions slightly wider than a width of the standard sheet. This setting is established by considering unevenness of sheets during manufacturing (the JIS permits an allowance of around 3 mm in each dimension for example) and that it is difficult to accurately align edges of sheets in a case where a large number of sheets is stacked.

However, if the distance between the pair of side restricting plates is widened, there is a case when a gap is generated between the sheets stacked on the intermediate plate and the side restricting plates, so that it is necessary to abut the sheets against the reference side restricting plate to align the edges of the sheets. In order for that, the non-reference side restricting plate is provided projectively with pressing members biased by springs toward the reference side restricting plate. Then, one end of the sheets are pressed by the pressing members to press the other end of the sheets to the reference side restricting plate to align the sheets in a state in which the sheets abut against the reference plane.

Here, if a force pressing the sheets by the pressing members is insufficient, it becomes unable to press the sheets against the reference plane of the reference side restricting plate, causing such problems that the sheet cannot be fed along the adequate reference position and that the sheet is fed askew. If the force of the pressing member pressing the sheet is too strong in contrary, the sheet is strongly pressed against the reference plane, causing such problems that the sheet is fed unstably due to a friction between the sheet and the reference plane and that the sheet is deformed unnecessarily.

Then, Japanese Patent Application Laid-open No. H5-105243 has disclosed a configuration in which the non-reference side restricting plate is provided, at an upper part thereof, with a pressing member that presses sheets at an upper part among sheets stacked on the intermediate plate against the reference side restricting plate by a weak force. The non-reference side restricting plate is also provided, at a lower part thereof, with a pressing member that presses sheets located at a lower part of the sheets stacked on the intermediate plate against the reference side restricting plate by a relatively strong force. This arrangement makes it possible to sequentially feed the sheets reliably from an adequate position without applying a large force from the pressing members to the sheet to be fed. It is also possible to align the lower part of the sheets on the intermediate plate reliably to the reference position by disposing the pressing member that presses the sheets by the relatively large force at the lower part of the non-reference side restricting plate.

By the way, in the sheet feeding device of the past, a vertical position around a rear end portion of the sheets changes considerably in the configuration in which the intermediate plate turns upward along with a decrease of a stacking amount of sheets. That is, while the position near an uppermost position of the rear end portion of the sheets stacked on the intermediate plate is located at an upper part of the side restricting plate when a full load of sheets is stacked, the position of the rear end portion of the sheets is located at a lower part of the side restricting plate when the intermediate plate turns upward along with the decrease of the sheets.

Due to that, when a remaining amount of the sheets is lessened, an upper part of the few remaining sheets is pressed by the large force by the pressing member disposed at the lower part of the non-reference side restricting plate. That is, it is unable to weakly press only the sheets near the upper most position regardless of the stacking amount of the sheets in the case where the vertical position around the rear end portion of the sheets changes considerably. Due to that, when the amount of stacked sheets is lessened, the sheets are pressed to the reference plane by the large pressing force of the pressing member, causing such problems that the feed of the sheet is destabilized by a friction between the sheet and the reference plane and that the sheet is deformed.

SUMMARY OF THE INVENTION

A sheet feeding device of the present invention includes a sheet feed cassette storing sheets and a sheet feeding portion configured to sequentially feed the sheets stored in the sheet feed cassette. The sheet feeding cassette includes a cassette body, a sheet stacking portion provided in the cassette body turnably in a vertical direction and pressing the stacked sheets against the sheet feeding portion, a first side edge restricting portion provided in the cassette body, a second side edge restricting portion disposed to face the first side edge restricting portion and restricting a position of the sheets in a width direction together with the first side edge restricting portion, a first pressing portion provided projectively in the width direction from the second side edge restricting portion downstream in the sheet feeding direction within the cassette body where the sheet feeding portion comes into contact with an uppermost sheet of the sheets stacked on the sheet stacking portion, formed such that a vertical width thereof is shorter than a maximum thickness of a sheet bundle stored in the cassette body, and configured to press the uppermost sheet against the first side edge restricting portion, a second pressing portion provided projectively in the width direction from the second side edge restricting portion upstream in the sheet feeding direction of the first pressing portion, formed such that a vertical width thereof is shorter than the maximum thickness of the sheet bundle, and configured to press the uppermost sheet against the first side edge restricting portion, and an interlock mechanism configured to turn the second pressing portion vertically in linkage with the sheet stacking portion.

Further features of the present invention will become apparent from the following description of exemplary embodiments (with reference to the attached drawings).

DESCRIPTION OF THE EMBODIMENTS

Figure 1:
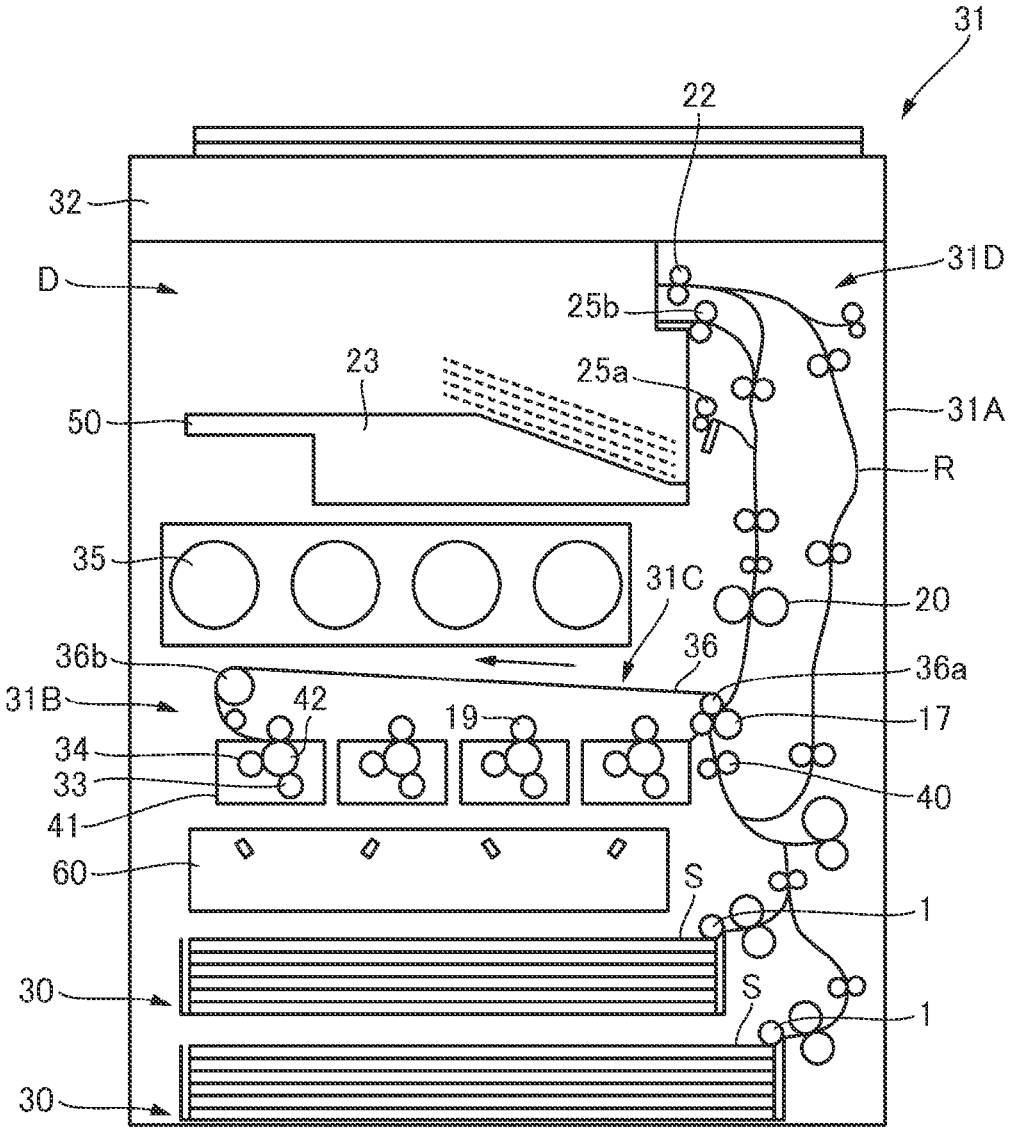
FIG. 1 is a schematic diagram illustrating a full-color laser beam printer which is one exemplary image forming apparatus provided with a sheet feeding device of a first embodiment of the present invention.

Embodiments of the present invention will be explained in detail with reference to the drawings. FIG. 1 is a diagram schematically showing a configuration of a full-color laser beam printer which is one exemplary image forming apparatus having a sheet feeding device according to a first embodiment of the invention.

As shown in FIG. 1 the full-color laser beam printer (referred to simply as a 'printer' hereinafter) 31 includes a printer body 31A, i.e., a body of the image forming apparatus, and an image forming portion 31B configured to form an image on a sheet. The printer 31 also includes an image reading unit 32 installed substantially horizontally on the printer body 31A. A sheet discharging space D for discharging sheets is formed between the image reading unit 32 and the printer body 31A. The printer 31 also includes a sheet feeding device 30 for feeding sheets and a toner cartridge 35.

The image forming portion 31B is of a four-drum full-color type and includes a laser scanner 60 and four process cartridges 41 forming four toner images of yellow (Y), magenta (M), cyan C), and black (K). Here, each process cartridge 41 includes a photoconductive drum 42, a charger 33, i.e., a charging portion, and a developer 34, i.e., a developing portion. The image forming portion 31B also includes an intermediate transfer unit 31C provided above the process cartridge 41.

The intermediate transfer unit 31C includes an intermediate transfer belt 36 suspended around a driving roller 36*a* and a tension roller 36*b*, and primary transfer rollers 19 provided inside of the intermediate transfer belt 36 and abutting against the intermediate transfer belt 36 at positions facing the respective photoconductive drums 42. Here, the intermediate transfer belt 36 is composed of a film-like member, is disposed so as to be in contact with the respective photoconductive drums 42, and is rotated in a direction of an arrow by the driving roller 36*a* driven by a driving portion not shown.

The respective color toner images having a negative polarity on the photoconductive drums are sequentially superimposed and transferred to the intermediate transfer belt 36 by applying a transfer bias of positive polarity to the intermediate transfer belt 36 by the primary transfer roller 19. A secondary transfer roller 17 that composes a secondary transfer portion transferring a color image formed on the intermediate transfer belt 36 to a sheet S is provided at a position facing the driving roller 36*a* of the intermediate transfer unit 31C.

A fixing portion 20 is provided above the secondary transfer roller 17, and a first discharge roller pair 25*a*, a second discharge roller pair 25*b*, and a both surface reversing portion 31D are provided above the fixing portion 20. The both surface reversing portion 31D includes a reversibly rotating reverse roller pair 22, a re-conveying path R for conveying a sheet on one side of which an image is formed again to the image forming portion 31B, and others.

Next, an image forming operation of the printer 31 constructed as described above will be explained. When image information of a document is read by the image reading unit 32, an image processing is implemented on this image information and then the image information is converted into electrical signals to be transmitted to the laser scanner 60 of the image forming portion 31B. It is noted that there is a case where the image information is inputted to the image forming portion 31B from an external apparatus such as a personal computer not shown.

In the image forming portion 31B, surfaces of the photoconductive drums 42 of the respective process cartridges 41 are scanned by laser beams corresponding to image information of yellow, magenta, cyan, and black component colors emitted from the laser scanner 60. Thereby, the surface of the photoconductive drum 42 which is homogeneously charged with a predetermined polarity and potential by the charger 33 is exposed sequentially and electrostatic latent images of yellow, magenta, cyan, and black are formed respectively and sequentially on the photoconductive drums of the respective process cartridges 41.

After that, the electrostatic latent images are developed and visualized by the respective color toners of yellow, magenta, cyan, and black, and the respective color toner images on the photoconductive drums are sequentially superimposed and transferred to the intermediate transfer belt 36 by the primary transfer bias applied to the respective primary transfer rollers 19. As a result, toner images are formed on the intermediate transfer belt 36.

Concurrently with the toner image forming operation, a sheet S is sent out of the sheet feeding device 30, is conveyed to a registration roller pair 40 so that a skew thereof is corrected, and is conveyed to the secondary transfer portion. Then, in the secondary transfer portion, the toner images are transferred to the sheet S in a batch by the secondary transfer bias applied to the secondary transfer roller 17.

Next, the sheet S on which the toner images have been transferred as described above is conveyed to the fixing portion 20. In the fixing portion 20, the respective color toners are melted and mixed by receiving heat and pressure and are fixed as a color image on the sheet S. Then, the sheet S on which the image has been fixed is discharged to a discharge space D by the first discharge roller pair 25*a* provided downstream of the fixing portion 20 and is stacked on a stacking portion 23 projecting from a bottom surface of the discharge space D.

Ina case where images are to be formed on both surfaces of the sheet S, the sheet S on which the image has been formed on one side thereof passes through the fixing portion 20 and arrives at the reversing roller pair 22. After that, the reversing roller pair 22 reversely rotates. Thereby, the sheet S is reversed, is conveyed to the re-conveying path R, and is conveyed again to the registration roller pair 40. Then, an image is formed and fixed again on another side of the sheet S, and the sheet S is discharged to the discharge space D by the first discharge roller pair 25*a* and is stacked on the stacking portion 23.

Figure 2:
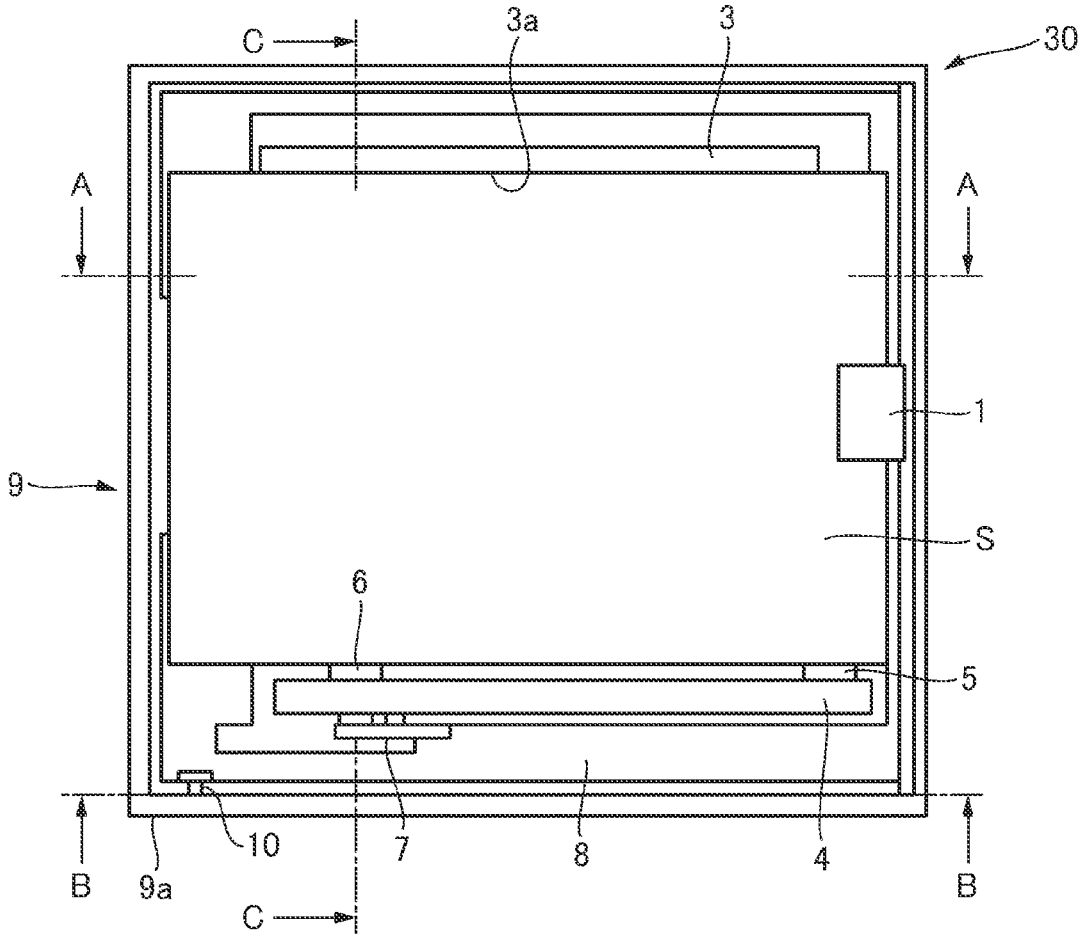
FIG. 2 is a diagram showing a configuration of the sheet feeding device.

FIG. 2 is a diagram illustrating a configuration of the sheet feeding device 30. The sheet feeding device 30 includes a sheet feeding cassette 9, and a sheet feeding roller 1, i.e., a sheet feeding portion, that feeds an uppermost sheet of the sheets S stored in the sheet feeding cassette 9. The sheet feeding cassette 9 is provided with an intermediate plate 8, i.e., a sheet stacking portion, provided in a cassette body 9*a* turnably in a vertical direction centering on a turn fulcrum 10, and a pair of right and left side restricting plates 3 and restricting a position of the sheet S stacked on the intermediate plate 8 in a width direction orthogonal to a sheet feeding direction of the sheet S. The intermediate plate 8 supports the sheet across a whole length thereof in the sheet feeding direction and has the turn fulcrum 10 at a downstream end thereof in the sheet feeding direction. The pair of side restricting plates 3 and 4 is provided to be approachable/separable to/from each other in the width direction corresponding to size of the sheet by a moving mechanism composed of a lack and a pinion not shown, and can be fixed at a position where the sheet is restricted by a lock mechanism not shown.

It is noted that in the present embodiment, one side restricting plate 3 among the pair of side restricting plates 3 and 4 is a first side edge restricting portion having a feed reference plane for feeding the sheet such that a position of the sheet matches adequately with the image formed in the image forming portion. The side restricting plate 3 having this feed reference plane will be referred to as a reference side restricting plate, and the side restricting plate 4, i.e., a second side edge restricting portion, disposed to face the reference side restricting plate 3 will be referred to as a non-reference side restricting plate hereinafter.

Because a distance between the reference side restricting plate 3 and the non-reference side restricting plate 4 is designed to be wider than a width of the sheet S when those plates are fixed in consideration of uneveness of dimensions of the sheet S at the time of manufacture, there is a case where a gap is generated between the sheet S and the side restricting plates 3 and 4. Then, in order to align the sheet S by abutting an end of the sheet S against the reference side restricting plate 3, the non-reference side restricting plate 4 is provided with a first pressing member (first pressing portion) 5 and a second pressing member (second pressing portion) 6 projectively toward the reference side restricting plate 3.

Figure 3:
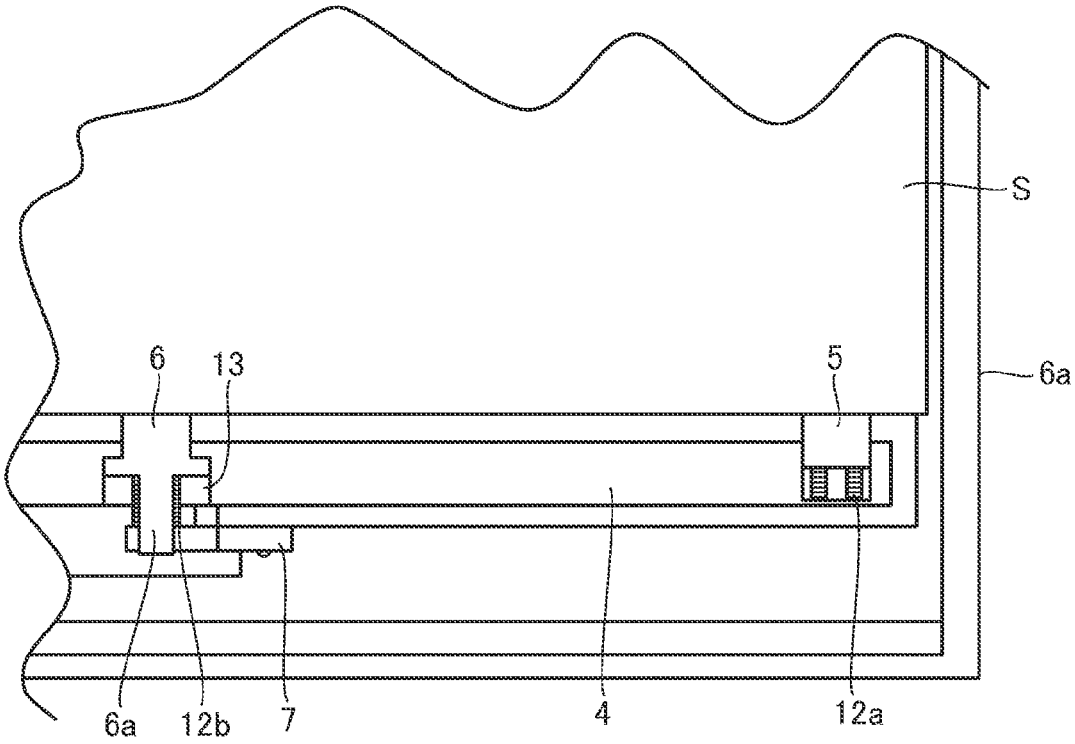
FIG. 3 is a diagram illustrating first and second pressing members provided on a non-reference side restricting plate of a sheet feeding cassette of the sheet feeding device.

It is noted that the first and second pressing members 5 and 6 project toward the reference side restricting plate 3 elastically by being biased by compression springs 12*a* and 12*b* such that the first and second pressing members 5 and 6 press the sheet S against the reference side restricting plate 3 as shown in FIG. 3. Thus, the gap between the sheet S and the feed reference plane of the reference side restricting plate 3 can be eliminated by pressing the sheet S against the reference side restricting plate 3 by the first and second pressing members 5 and 6. It is noted that a pressing force of the first pressing member 5 pressing the sheet is regulated by the compression spring 12*a*, i.e., a first elastic body, and a pressing force of the second pressing member 6 pressing the sheet is regulated by the compression spring 12*b*, i.e., a second elastic body. These first and second elastic bodies may be realized also by forming the first and second pressing members 5 and 6 themselves by an elastic member such as rubber. A columnar boss 6*a* described later is also formed on a side of the second pressing member 6 opposite from a plane thereof in contact with the sheet, and the compression spring 12*b* of the second pressing member 6 is provided between the second pressing member 6 and a lever 7 described later.

Figure 4A:
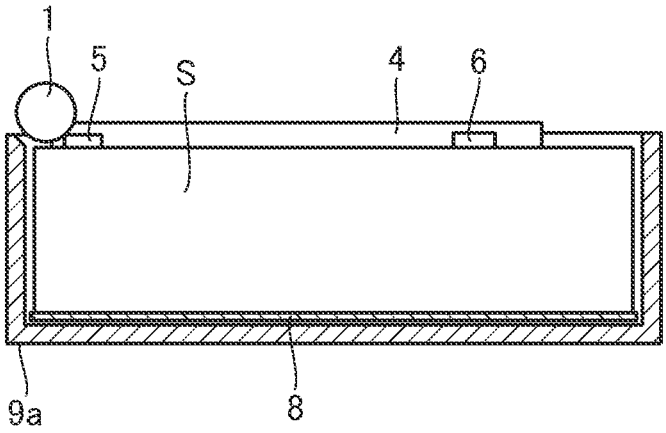
FIG. 4A is a diagram schematically illustrating changes of position of the second pressing member along with a stacking amount of sheets stored in the sheet feeding cassette in a case where a full amount of sheets is stacked.
Figure 4B:
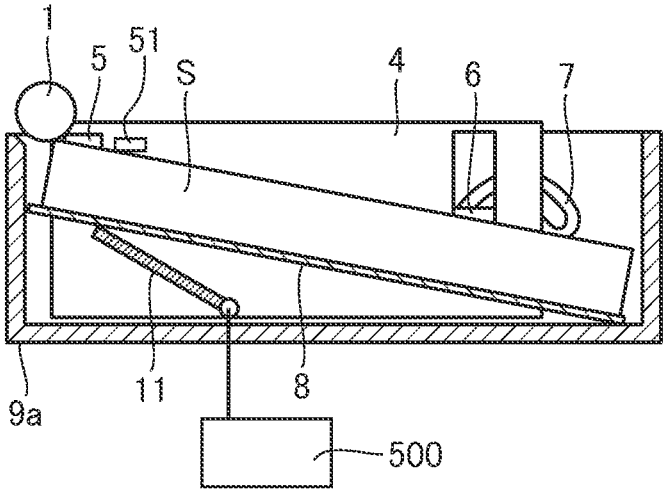
FIG. 4B is a diagram schematically illustrating the changes of position of the second pressing member along with a stacking amount of sheets stored in the sheet feeding cassette in a case where a medium amount of sheets is stacked.
Figure 4C:
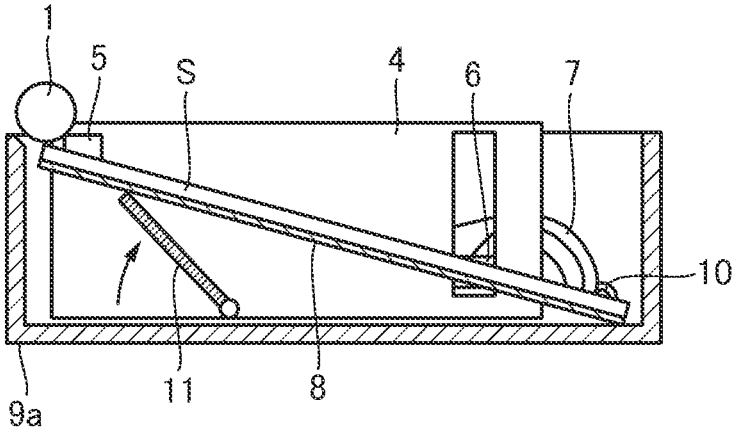
FIG. 4C is a diagram schematically illustrating the changes of position of the second pressing member along with a stacking amount of sheets stored in the sheet feeding cassette in a case where a small amount of sheets is stacked.

As shown in FIGS. 4B and 4C, the sheet feeding cassette 9 is provided with a lifter plate 11, i.e., a turning portion, in contact with a bottom plane of the intermediate plate 8 and configured to lift and turn the intermediate plate 8 upward by a drive portion 500 such as a motor. In a case where a large amount of the stacked sheets S is left, the intermediate plate 8 is located at a bottom surface of the cassette body 9*a* as shown in FIG. 4A. As the sheets S are fed and the remaining amount of the sheets S decreases, the intermediate plate 8 is turned upward as shown in FIGS. 4B and 4C to bring the stacked sheet S into contact with the sheet feeding roller 1. More specifically, the control portion 50 detects whether or not a position of an uppermost sheet S1 of the sheets S on the intermediate plate 8 is located at a predetermined position (a range in which the sheet can be fed by the sheet feeding roller 1) on a basis of a detection signal of a sensor 51. When the control portion 50 judges that the remaining amount of the sheets S has decreased as shown in FIG. 4C on the basis of the detection signal, e.g., from ON to OFF, of the sensor 51, the control portion 50 controls the drive portion 500 to lift the intermediate plate 8 until when the uppermost sheet S1 is detected by the sensor 51, e.g., from OFF to ON.

By the way, in the present embodiment, the first and second pressing members 5 and 6 are formed such that widths (length) thereof in the vertical direction are shorter than a maximum thickness of a bundle of sheets (a dimension of height of the sheets stacked in maximum) that can be stored in the cassette body and are disposed such that the pressing members press upper parts (upper surface) of the plurality of sheets S stored in the sheet feeding cassette 9. The first pressing member 5 presses the upper part of a front end side (downstream in the sheet feeding direction) of the plurality of sheets S, and the second pressing member 6 presses the upper part of a rear end side (upstream in the sheet feeding direction) of the plurality of sheets S. This performance is carried out to feed an uppermost sheet of the bundle of sheets stacked on the intermediate plate 8 at a normal position in the width direction (adequate position with respect to a position of an image) and to prevent the fed sheet from skewing in feeding the uppermost sheet by the sheet feeding roller 1 while abutting the uppermost sheet against the reference side restricting plate 3.

Figure 5A:
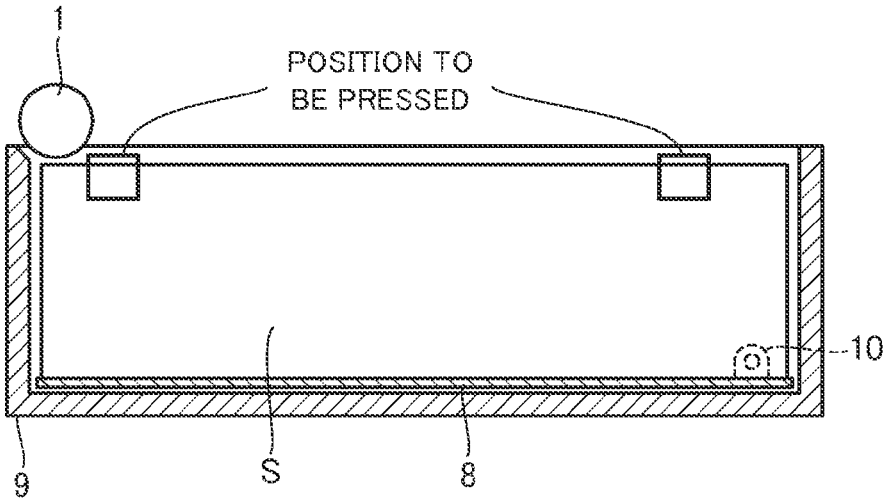
FIG. 5A is a diagram illustrating positions where a full amount of sheets stored in the sheet feeding cassette is to be pressed by the first and second pressing members.
Figure 5B:
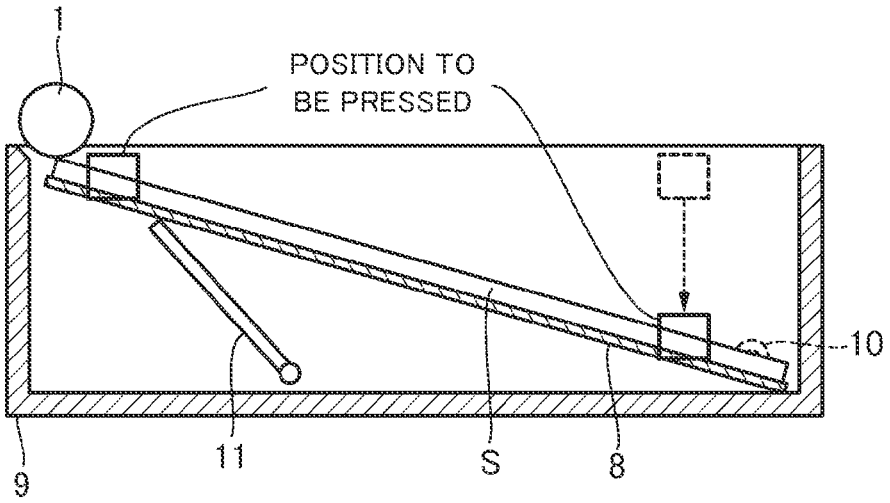
FIG. 5B is a diagram illustrating positions where a small amount of sheets stored in the sheet feeding cassette is to be pressed by the first and second pressing members.

It is noted that FIGS. 5A and 5B show positions of the upper part of the plurality of sheets S to be pressed by the first and second pressing members 5 and 6. While the positions of the upper part of the sheets S to be pressed are located at positions as shown in FIG. 5A when the remaining amount of the stacked sheets S is large, the positions drop to positions as shown in FIG. 5B when the remaining amount of the sheets S decreases. That is, at the downstream side of the sheet bundle stacked on the intermediate plate 8, the intermediate plate 8 turns on the basis of the detection signal of the sensor 51 and the upper surface of the uppermost sheet is located substantially at the same position regardless of the remaining amount of the sheets S as described above. Therefore, the position of the upper part of the downstream side of the sheet bundle is located substantially at the same position. In contrary, the position of the upper part of the upstream side of the sheet bundle drops gradually as the sheets S decrease.

That is, if the intermediate plate 8 turns upward, while the vertical position of the upper part of the sheet of the front end side does not change as shown in FIG. 5B, the position of the rear end side changes significantly. It is noted that if the position of the rear end side is pressed by a vertically long member for example, it becomes unable to press the rear end side with an adequate pressing force and there is a possibility of causing feeding failure or the like of the sheet because an amount of the sheets brought in contact with the pressing member changes depending on the remaining amount of the sheets as described above. That is, a large pressing force is set for the vertically long pressing member because it is necessary to press the maximum amount of sheets S stacked on the intermediate plate 8 against the reference side restricting plate 3 by resisting against a weight thereof. Therefore, if the amount of the sheets S stacked on the intermediate plate 8 decreases, the sheets S are pressed against the reference side restricting plate 3 by a large force of the pressing member, and there is a possibility that the sheet cannot be fed by the sheet feeding roller 1.

Therefore, the present embodiment is configured such that the second pressing member 6 drops along with the decrease of the sheet remaining amount. This configuration makes it possible to always press a vicinity of the upper part of the sheet and to press the rear end side by an adequate pressing force regardless the sheet stacking amount. Next, a configuration of dropping the second pressing member 6 along with the decrease of the sheet remaining amount will be explained with reference to FIG. 6.

FIG. 6 shows an interlock mechanism 2 configured to drop the second pressing member 6 along with the decrease of the sheet remaining amount. That is, the interlock mechanism 2 is configured to move the second pressing member 6 vertically corresponding to a total thickness of the sheets (a thickness of the sheet bundle stacked) on the intermediate plate 8. Specifically, the interlock mechanism 2 includes a lever 7, i.e., an interlock member, supported turnably in the vertical direction centering on a turn fulcrum 14 on an outside surface of the non-reference side restricting plate 4. The lever 7 includes an arcuate slide groove 16, i.e., a guide portion, formed to move the second pressing member 6 in the vertical direction along with a turn of the lever 7.

The columnar boss 6*a* formed on the side opposite from the plane of the second pressing member 6 against which the sheet abuts as shown in FIG. 3 described above is inserted into the slide groove 16. The lever 7 is also provided with an engage portion 15 that engages with an upper surface of the intermediate plate 8 at a lower end thereof. It is noted that an opening 13 shown in FIG. 6 is perforated through the non-reference side restricting plate 4 such that the second pressing member 6 is movable in the vertical direction.

Figure 6A:
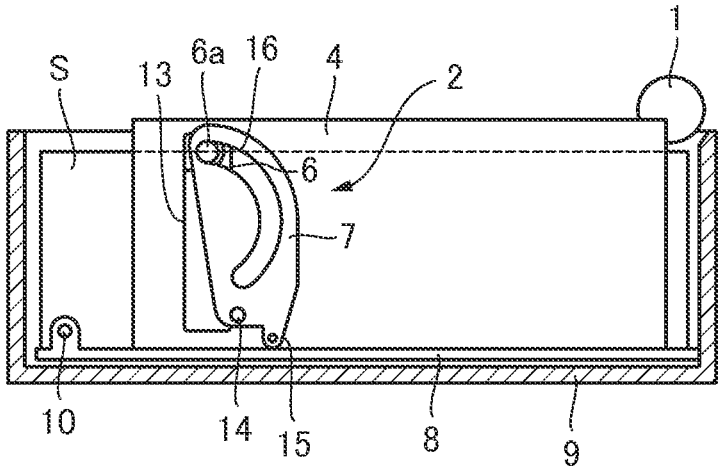
FIG. 6A is a diagram illustrating a configuration of lowering the second pressing member along with a decrease of the sheets left in the sheet feeding cassette in a case where a full amount of sheets is stacked.

Here, FIG. 6A shows a condition in which a large amount of sheets S is stacked. At this time, the second pressing member 6 is located at a higher position such that the second pressing member 6 can press the upper part on the rear end side of the sheets S. Then, when the sheets S are fed sequentially, the amount of stacked sheets decreases, and the intermediate plate 8 is turned upward gradually, the engage portion 15 of the lever 7 is pushed up by the intermediate plate 8, and the lever 7 turns upward together with the intermediate plate 8 centering on the turn fulcrum 14.

Figure 6B:
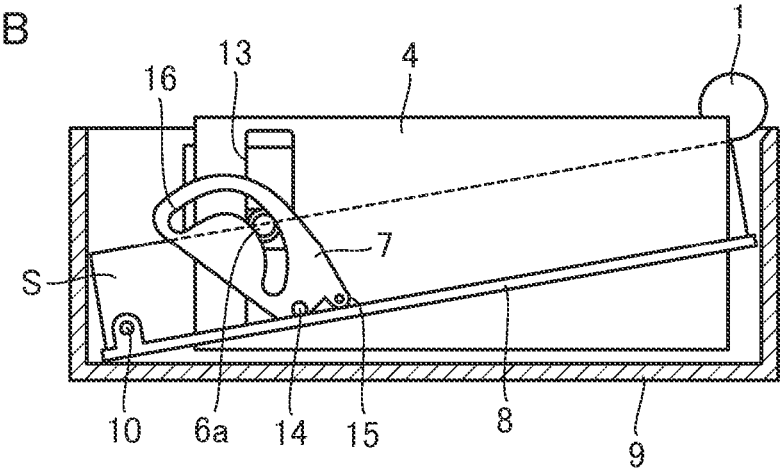
FIG. 6B is a diagram illustrating the configuration of lowering the second pressing member along with a decrease of the sheets left in the sheet feeding cassette in a case where a medium amount of sheets is stacked.
Figure 6C:
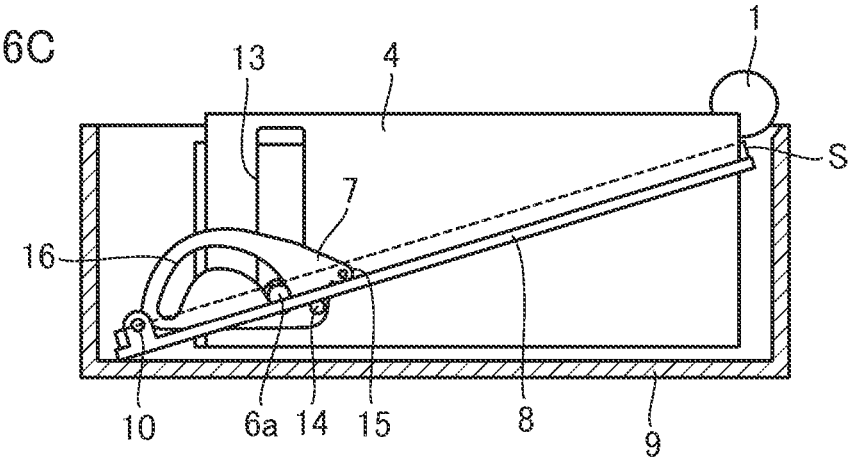
FIG. 6C is a diagram illustrating the configuration of lowering the second pressing member along with a decrease of the sheets left in the sheet feeding cassette in a case where a small amount of sheets is stacked.

When the lever 7 turns upward, the second pressing member 6 receives a force in a dropping direction from the lever 7 through an intermediary of the columnar boss 6*a* engaged with the slide groove 16 and drops along the opening 13. Thereby, in a condition in which a medium amount of sheets is stacked, the interlock mechanism 2 moves to a position where the second pressing member 6 can press the upper part on the rear end side of the stacked sheets of the medium amount as shown in FIG. 6B. In a condition in which a small amount of sheets is stacked, the second pressing member 6 moves to a lower position where the second pressing member 6 presses the upper part on the rear end side of the small amount of the stacked sheets as shown in FIG. 6C. That is, the first pressing member 5 disposed downstream in the sheet feeding direction of the lever 7 which is the interlock member of the cassette body 9*a* where the sheet feeding roller 1 comes into contact with the uppermost sheet S1 of the sheets stacked on the intermediate plate 8 is fixed at a position where the first pressing member 5 can press the uppermost sheet S1 when the sheet feeding roller 1 comes into contact with the uppermost sheet S1. Meanwhile, the second pressing member 6 disposed upstream in the sheet feeding direction of the first pressing member 5 is configured to drop along with the upward turn of the intermediate plate 8 and to rise along with the downward turn of the intermediate plate 8 by the interlock mechanism 2. This configuration makes it possible for the second pressing member 6 to press the uppermost sheet S1 (partly the upper part including the uppermost sheet S1 in a case where the total thickness of the sheets is thick) regardless of the stacking amount (total thickness) of the sheets on the intermediate plate 8.

In the present embodiment, the second pressing member 6 drops when the sheet stacking amount decreases and the intermediate plate 8 rises. Then, because the second pressing member 6 drops due to the decrease of the sheets, it is possible to press the upper part on the rear end side of the sheets by the second pressing member 6 even when the upper part on the rear end side of the sheets drops. It is noted that when the intermediate plate 8 drops as sheets are replenished on the intermediate plate 8, the lever 7 turns downward and the second pressing member 6 rises. Thereby, it is possible to press the upper part on the sheet rear end side by the second pressing member 6 even if the upper part on the sheet rear end side rises.

Because the pressing force required to align the sheets by pressing the sheets toward the reference side restricting plate 3 becomes constant by moving the second pressing member 6 in the vertical direction along with the turn of the lever 7 as described above, it becomes possible to press the sheets with the adequate pressing force. As a result, it is possible to suppress the sheets from being deformed by an excessive pressing force or from not being sufficiently corrected by an insufficient pressing force. It is also possible to suppress an image defect from occurring due to a deviation of a sheet feeding position and to prevent the sheets from being fed defectively or from being fed in askew.

It is noted that it is desirable to minimize an amount (area) by which the second pressing member 6 comes into contact with the sheet S. Such arrangement makes it possible to prevent the sheet from being unnecessarily deformed even when a few sheets is left because the pressing force to be set is also lowered. For instance, in a conventional configuration using a vertically long second pressing member, sheets are pressed by a less force (around 1 N) as compared a force to be applied to a certain amount of sheets to prevent unnecessary deformation that could happen when the sheet remaining amount is lessened.

However, the present embodiment makes it possible to prevent such deformation of a few stacked sheets and to obtain a sufficient pressing effect by setting the pressing force to be still weaker, e.g., 0.5 N. That is, it is possible to lower the required pressing force and to suppress the unnecessary deformation of the sheets effectively by reducing the degree of the second pressing member 6 coming into contact with the sheet S.

As described above, the present embodiment makes it possible to press the upper part on the upstream side of the sheet feeding direction of the sheets by the adequate pressing force regardless of the sheet remaining amount by the simple structure of moving the second pressing member 6 in the vertical direction in linkage with the turn of the intermediate plate 8. Thereby, it is possible to provide the sheet feeding device 30 that is capable of pressing the rear end of the sheets by the adequate pressing force regardless of the remaining amount of the sheets S simply at low cost.

Figure 7A:
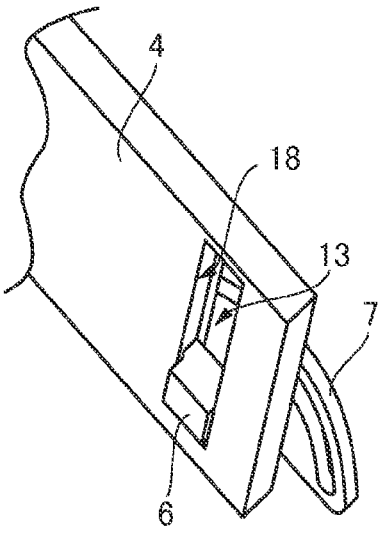
FIG. 7A is a diagram illustrating a configuration of a non-reference side restricting plate provided in a sheet feeding cassette of a sheet feeding device of a second embodiment of the present invention.
Figure 7B:
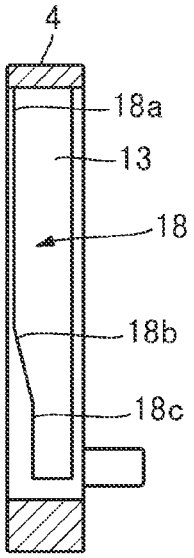
FIG. 7B is a side section view of the non-reference side restricting plate shown in FIG. 7A.
Figure 7C:
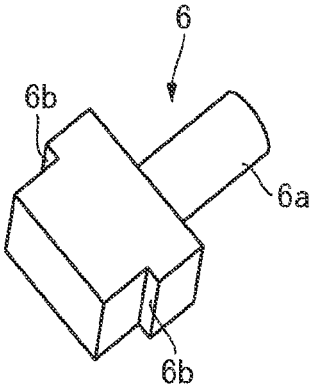
FIG. 7C is a perspective view showing the second pressing member.

Next, a second embodiment of the invention will be explained. FIGS. 7A, 7B, and 7C illustrate a configuration of the non-reference side restricting plate provided in the sheet feeding cassette of the sheet feeding device of the present embodiment. It is noted that the same reference numerals with those in FIG. 3 described above denote the same or corresponding parts in FIG. 7.

As shown in FIG. 7A, the non-reference side restricting plate 4 includes an abutting face 18, i.e., a restricting portion, provided along both edge portions of an opening 13 to restrict a projection amount of the second pressing member 6. As shown in FIG. 7B, the abutting face 18 has an upper straight portion 18*a* provided at an upper part thereof, a lower straight portion 18*c* provided at a lower part thereof, and an inclined portion 18*b* provided between the upper and lower straight portions 18*a* and 18*c* and inclined toward outside in the width direction of the non-reference side restricting plate 4. As shown in FIG. 7C, the second pressing member 6 is provided with abutting portions 6*b* formed to be in contact with the abutting face 18.

Figure 8A:
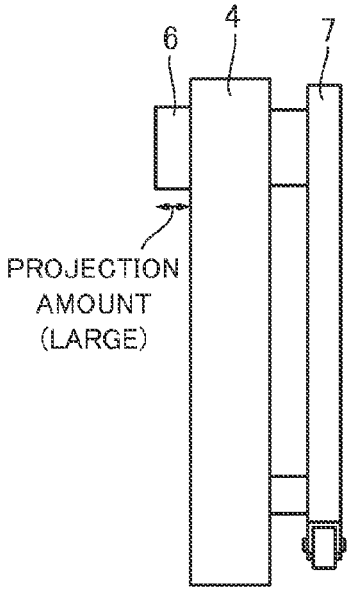
FIG. 8A is a diagram illustrating a position of the second pressing member provided on the non-reference side restricting plate in a case where a projection amount is large.

The second pressing member 6 is biased to the abutting face 18 side by the compression spring 12*b* shown in FIG. 3 and described above and provided between the second pressing member 6 and the lever 7. Thereby, a projection amount of the second pressing member 6 is set in accordance to a position where the second pressing member 6 is in contact with the abutting face 18. For instance, in the condition in which the stacking amount of the sheets S is large, the second pressing member 6 is located at an upper position shown in FIG. 8A. Because the second pressing member 6 is in contact with the upper straight portion 18*a* of the abutting face 18 at this time, the projection amount is large.

Figure 8B:
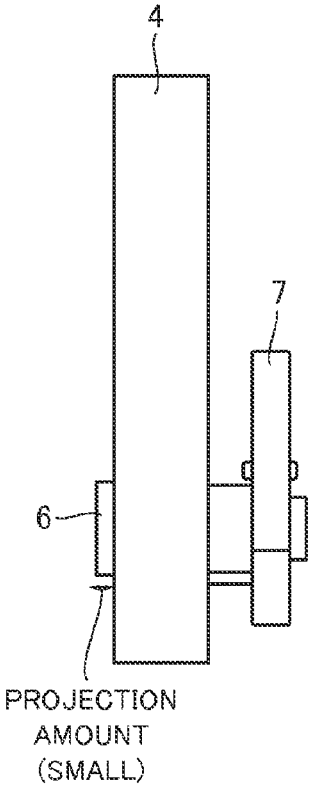
FIG. 8B is a diagram illustrating a position of the second pressing member provided on the non-reference side restricting plate in a case where the projection amount is small.

When the stacking amount of the sheets S decreases, the second pressing member 6 drops along with the upward turn of the intermediate plate 8. At this time, the second pressing member 6 is brought in contact the lower straight portion 18*c* of the abutting face 18, so that the projection amount decreases as shown in FIG. 8B. That is, according to the present embodiment, the projection amount of the second pressing member 6 can be reduced along with the decrease of the stacking amount of the sheets.

In a case where rigidity of sheets is low, the sheets may be deformed if the projection amount of the second pressing member 6 is large when a number of the stacked sheets decreases to a few final sheets. However, it is possible to prevent the sheets whose rigidity is low and which are liable to be bent from being deformed even if a few stacked sheets is left by reducing the projection amount of the second pressing member 6 corresponding to the decrease of the stacking amount of the sheets like the present embodiment.

It is noted that the projection amount of the second pressing member 6 is set by considering the unevenness of dimensions of sheets in manufacturing the sheets and that it is difficult to accurately align edges of sheets when a large number of sheets is to set. Therefore, even if the projection amount is reduced in a case where the edges can be readily aligned, i.e., in a case where the stacking amount of the sheets is small, the effect of aligning the sheets by the reference side restricting plate is not reduced as long as a projection amount that absorbs the unevenness of the dimension of the sheets is assured.

As described above in the present embodiment, it is possible to minimize deformation of the sheets while keeping the effect of aligning the sheets by the reference side restricting plate by reducing the projection amount of the second pressing member 6 along with the decrease of the stacking amount of the sheets.

It is noted that the intermediate plate 8 is configured to support a whole length of the sheet in the embodiment described above, the intermediate plate 8 may be configured to support a length to a center part of the cassette body. In this case, the side restricting plates are formed substantially into a same length with that of the intermediate plate, and the first and second pressing members of the present embodiment are disposed thereon. Still further, the intermediate plate may be configured to bring an uppermost sheet into contact with the feed roller only when the sheet is to be conveyed and to move up and down such that the uppermost sheet is separated from the feed roller when the sheet is not fed. While the both right and left side restricting plates are configured to move in the width direction in linkage in the present embodiment, they may be configured such that one side restricting plate, e.g., the reference side restricting plate, is fixed and the other side restricting plate, e.g., the non-reference side restricting plate, is movable.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-040555, filed on Mar. 1, 2013, which is hereby incorporated by reference herein in its entirety.

What is claimed is:

1. A sheet feeding device comprising:

a sheet feed cassette; and a sheet feeding portion configured to sequentially feed sheets stored in the sheet feed cassette;

the sheet feed cassette including:

a cassette body;

a sheet stacking portion provided in the cassette body turnably in a vertical direction and pressing the stacked sheets against the sheet feeding portion;

a first side edge restricting portion provided in the cassette body;

a second side edge restricting portion disposed to face the first side edge restricting portion and restricting a position of the sheets in a width direction together with the first side edge restricting portion;

a first pressing portion provided projectively in the width direction from the second side edge restricting portion, formed such that a vertical width thereof is shorter than a maximum thickness of a sheet bundle that can be stored in the cassette body, and configured to press an uppermost sheet of the stacked sheets against the first side edge restricting portion;

a second pressing portion provided projectively in the width direction from the second side edge restricting portion upstream in a sheet feeding direction of the first pressing portion, formed such that a vertical width thereof is shorter than the maximum thickness of the sheet bundle that can be stored in the cassette body, and configured to press the uppermost sheet against the first side edge restricting portion; and an interlock mechanism configured to move the second pressing portion vertically in linkage with the sheet stacking portion such that the second pressing portion lowers along with an upward turn of the sheet stacking portion and lifts along with a downward turn of the sheet stacking portion.

2. The sheet feeding device according to claim 1, wherein the first pressing portion is fixed at a position where the first pressing portion is to press the uppermost sheet when the uppermost sheet is brought into contact with the sheet feeding portion.

3. The sheet feeding device according to claim 2, wherein the first pressing portion includes a first elastic body that regulates a pressing force for pressing the uppermost sheet; and the second pressing portion includes a second elastic body that regulates a pressing force for pressing the uppermost sheet.

4. The sheet feeding device according to claim 1, wherein the interlock mechanism includes an interlock member provided turnably in the vertical direction on an outside surface of the second side edge restricting portion and engaging with the sheet stacking portion; and a guide portion that guides the second pressing portion to move in the vertical direction when the interlock member turns along with a turn of the sheet stacking portion.

5. The sheet feeding device according to claim 3, wherein the interlock mechanism includes an interlock member provided turnably in the vertical direction on an outside surface of the second side edge restricting portion and engaging with the sheet stacking portion; and a guide portion that guides the second pressing portion to move in the vertical direction when the interlock member turns along with a turn of the sheet stacking portion.

6. The sheet feeding device according to claim 4, wherein the guide portion is an arcuate groove formed on the interlock member and moves the second pressing portion in the vertical direction as the interlock member turns.

7. The sheet feeding device according to claim 5, wherein the guide portion is an arcuate groove formed on the interlock member and moves the second pressing portion in the vertical direction as the interlock member turns.

8. The sheet feeding device according to claim 4, wherein the second side edge restricting portion is provided with an opening that permits the second pressing portion to move in the vertical direction; and the second pressing portion moves in the vertical direction while guided by the opening when the interlock member turns.

9. The sheet feeding device according to claim 7, wherein the second side edge restricting portion is provided with an opening that permits the second pressing portion to move in the vertical direction; and the second pressing portion moves in the vertical direction while guided by the opening when the interlock member turns.

10. The sheet feeding device according to claim 1, wherein the second side edge restricting portion is provided with a restricting portion configured to restrict such that a projection amount of the second pressing portion is reduced along with a decrease of a stacking amount of sheets.

11. The sheet feeding device according to claim 9, wherein the second side edge restricting portion is provided with a restricting portion configured to restrict such that a projection amount of the second pressing portion is reduced along with a decrease of a stacking amount of sheets.

12. An image forming apparatus comprising:

an image forming portion configured to form an image on a sheet; and a sheet feeding device as set forth in claim 1 configured to feed the sheet to the image forming portion.

13. The image forming apparatus according to claim 12, wherein the first side edge restricting portion includes a feed reference plane which is a reference plane for feeding the sheet to a position where the image formed in the image forming portion is matched widthwise with the sheet; and the first and second pressing portions press the sheet against the feed reference plane facing to the second side edge restricting portion.

* * * * *